US010017321B2

(12) United States Patent
Empey

(10) Patent No.: US 10,017,321 B2
(45) Date of Patent: Jul. 10, 2018

(54) BRUSH HOLDER

(71) Applicant: Pauline Frances Empey, Milwaukie, OR (US)

(72) Inventor: Pauline Frances Empey, Milwaukie, OR (US)

( * ) Notice: Subject to any disclaimer, the term of this patent is extended or adjusted under 35 U.S.C. 154(b) by 183 days.

(21) Appl. No.: 14/509,926

(22) Filed: Oct. 8, 2014

(65) Prior Publication Data

US 2016/0101927 A1 Apr. 14, 2016

(51) Int. Cl.

| | |
|---|---|
| ***B65D 85/20*** | (2006.01) |
| ***B44D 3/00*** | (2006.01) |
| ***B65B 5/06*** | (2006.01) |
| ***B65B 7/28*** | (2006.01) |
| ***B65B 69/00*** | (2006.01) |
| ***B65D 59/06*** | (2006.01) |
| *A46B 17/00* | (2006.01) |
| *A45C 11/36* | (2006.01) |
| *B44D 3/12* | (2006.01) |

(Continued)

(52) U.S. Cl.

CPC ..... *B65D 85/20* (2013.01); *B65B 5/06* (2013.01); *B65B 7/28* (2013.01); *B65B 69/00* (2013.01); *B65D 59/06* (2013.01); *A45C 11/34* (2013.01); *A45C 11/36* (2013.01); *A46B 17/00* (2013.01); *B44D 3/12* (2013.01); *B44D 3/123* (2013.01); *B44D 3/125* (2013.01); *B65D 59/04* (2013.01)

(58) Field of Classification Search

CPC ..... Y10S 206/804; B44D 3/123; B44D 3/12; B44D 3/02; B44D 3/125; B44D 3/04; A47F 7/0021; B43K 23/00; A45C 11/34; A45C 11/36; G07D 9/004; A46B 2200/205; A46B 2200/405; A46B 17/00; A46B 17/02; B65D 85/20; B65D 5/06; B65D 7/28; B65D 69/00; B65D 59/06; B65D 59/04

USPC ..... 206/739, 443, 523, 804, 1.7, 362, 214, 206/371, 446, 380, 292, 1.8, 1.9, 575; 229/93, 122.33; 211/69.1, 65; D3/206, D3/300; D19/75, 85

See application file for complete search history.

(56) References Cited

U.S. PATENT DOCUMENTS 629,586 A * 7/1899 McIntyre ..... B44D 3/02 206/1.7
844,114 A * 2/1907 Foster ..... A45C 11/34 206/1.7

(Continued)

OTHER PUBLICATIONS

Dec. 22, 2015, International Search Report of the International Searching Authority of the U.S. Receiving Office in PCT/US2015/054042, which is an international application that claims priority to this U.S. application.

(Continued)

*Primary Examiner* — J. Gregory Pickett
*Assistant Examiner* — Gideon Weinerth
(74) *Attorney, Agent, or Firm* — Kolisch Hartwell, P.C.

(57) ABSTRACT

A container may be provided with an open-ended cylinder for use in storage and carrying of the brushes in combination with a cup that supports the handles of the brushes during display and/or use or the brushes. The cup and the sheath are releasably couplable to carry the elongate items within the cup and sheath. The container may include first and second caps, each cap defining a first open end configured to fit over one of the open ends of the sheath to maintain the coupling of the cup and sheath.

20 Claims, 6 Drawing Sheets

(51) Int. Cl.
*A45C 11/34* (2006.01)
*B65D 59/04* (2006.01)

(56) References Cited

U.S. PATENT DOCUMENTS 1,195,451 A * 8/1916 Eisenhardt ..... A24F 15/06 312/73
1,584,261 A 5/1926 Vuolo
2,275,542 A * 3/1942 Menges ..... B65D 3/00 206/769
2,852,132 A 9/1958 Steinberger et al.
2,912,138 A * 11/1959 Bishop ..... B65D 51/24 220/521
2,996,864 A * 8/1961 Cook ..... G07D 9/065 53/212
3,156,364 A * 11/1964 Wolcott ..... B44D 3/125 206/209
3,190,438 A * 6/1965 Cain ..... B65D 83/02 206/740
3,727,748 A 4/1973 Brown
3,847,274 A * 11/1974 Inglish ..... B65D 83/02 206/443
4,051,992 A * 10/1977 Bergstein ..... B65D 15/08 229/162.5
D248,337 S * 6/1978 Marx ..... D3/284
4,163,517 A * 8/1979 Kappler ..... B65D 59/00 220/916
4,289,249 A 9/1981 Cripe
4,573,571 A 3/1986 Leem
4,777,969 A 10/1988 Holloway
4,802,577 A * 2/1989 O'Leary ..... B65D 85/00 206/278
4,852,833 A 8/1989 Lockwood
4,936,046 A 6/1990 Miller
5,301,799 A * 4/1994 Gurba, Jr. ..... B44D 3/123 206/1.7
5,464,141 A * 11/1995 Brindle ..... B60R 9/055 206/443
5,634,569 A 6/1997 DeCoster
D417,949 S * 12/1999 Fantinelli ..... D3/206
6,216,856 B1 * 4/2001 Park ..... B43M 99/003 206/214
D443,126 S * 5/2001 Reviea ..... D99/34
6,398,027 B1 6/2002 Ryu
6,557,750 B1 * 5/2003 Druse ..... B65D 59/04 206/37.1
6,974,026 B2 * 12/2005 Chan ..... A45C 11/34 206/214
D551,862 S * 10/2007 Gerry ..... D3/300
8,286,790 B1 10/2012 McBryar
D677,047 S * 3/2013 Watson ..... D3/203.5
2004/0195133 A1 * 10/2004 Duncan ..... A47F 5/02 206/443
2005/0056566 A1 3/2005 Lee
2005/0092648 A1 * 5/2005 Jin ..... A45C 11/34 206/575
2005/0224392 A1 10/2005 Perry et al.
2007/0199575 A1 8/2007 Del Ponte
2008/0110881 A1 * 5/2008 Schulz ..... A61M 1/3675 220/8
2009/0050584 A1 * 2/2009 Muhlbaier ..... B65D 83/0005 211/59.3
2009/0255933 A1 * 10/2009 Zeyfang ..... B65D 55/16 220/375
2011/0031136 A1 * 2/2011 Strain ..... B44D 3/04 206/1.7
2011/0293352 A1 12/2011 Kim
2014/0311934 A1 * 10/2014 Beadles ..... B65D 81/107 206/446
2014/0332420 A1 * 11/2014 Kellner ..... B65D 81/264 206/204

OTHER PUBLICATIONS

Dec. 22, 2015, Written Opinion of the International Searching Authority of the U.S. Receiving Office in PCT/US2015/054042, which is an international application that claims priority to this U.S. application.

Apr. 20, 2017, International Preliminary Report on Patentability of The International Bureau of WIPO in PCT/US2015/054042, which is an international application that claims priority to this U.S. application.

* cited by examiner

BRUSH HOLDER

BACKGROUND

The embodiments of the present invention relate to a structure and components for a container to hold brushes and other contents. For example, the container may be used to hold makeup brushes, paint brushes, and any type of brushes and similarly structured tools where a user may want to carry and store an assortment of several and to be able to display the assortment and select one at a time.

Various devices have been developed for similar purposes: soft-sided structures, such as bags or pouches, folding sleeves or envelopes, or, alternatively hard-shelled canisters. The soft-sided carriers typically lack any convenient capability for displaying the tools in an upright position, and also tend to wrap around the working ends of the tools causing contact that is disadvantageous both in terms of damage to the tools and discoloration of the carrier. The soft-sided carriers also have the disadvantages of not protecting well against damage or moisture and of requiring a large flat surface area for display and use of the brushes.

The hard-shell canister might provide for upright display of the tools but has other disadvantages. The canister-style structure is typically two cylinders, each closed on one end, and one of the cylinders is a bottom container to hold the tools and the other is a top cover. The cylinders fit or snap together and they may be secured with side straps. The canister-style device does not transition well, however, from the display configuration to the storage configuration because when the cap is replaced over the tools, the cap tends to bump into the working ends of the tool, potentially causing damage. To prevent damage, the user must carefully fit the tools inside the cap as it is installed. To facilitate fitting the tools inside the cap on installation, the canister-style containers are typically sized larger and heavier relative to the tools than would otherwise be necessary.

BRIEF SUMMARY

According to one embodiment of the present invention, a container may be provided for carrying one or more elongate items. The container may also be configured to be placed on a flat surface and to present the items for selection and use. The container may comprise a sheath, defining a first open end, a second open end, and a channel extending between the ends. Typically the sheath is longer than the longest of the elongate items. The container may also include a cup configured to hold the elongate items. The cup may include an open end to receive the elongate items and a base opposite the open end configured to support the cup on the flat surface.

Typically, the cup is shorter than the sheath and the elongate items. The cup and the sheath may be releasably couplable to carry the elongate items within the cup and sheath, and the cup, with the sheath removed, is configured to present the items for selection and use. The cup's length may be selected relative to the elongate items so that, when presented or displayed in the cup, the elongate items splay outwardly for convenient individual selection and grasping by the user's hand. As one example, the cup length may be selected to be less than about half the length of the longest elongate item. Preferably the cup is not so short as to allow the elongate items to fall out of the cup in the display configuration.

The container may also include first and second caps, with each cap having a first open end configured to fit over one of the open ends of the sheath to maintain the coupling of the cup and sheath. Such cap may be provided with a transparent or translucent panel, or mesh or other openings in its structure to allow the user to see or otherwise to determine the location of the cup and/or elongate items inside the sheath.

The sheath, cup, and caps are preferably constructed with the same cross-sectional shape, i.e., all circular or all rectangular or all square or all hexagonal cross-sections, etc. The description herein is generally directed toward the cylindrical, i.e., circular cross-section, shape with the understanding that similar concepts apply for other cross-sections. Alternatively, the sheath, cup, and caps may be constructed with differing cross-sectional shapes but preferably still consonant with the concepts described herein for fitting the sheath, cup, and caps together. The container may include additional structure surrounding the sheath and caps, which may be used for decorative purposes.

Typically, the cup has an outer diameter that is sized relative to the inner diameter of the sheath to fit inside the channel of the sheath with a close enough tolerance for a frictional or sliding fit that promotes the cup's remaining coupled to the sheath unless and until the user decouples them.

The caps may include a retaining structure releasably connecting the caps to the sheath, such as a friction fit or a detent and ring structure or a screw thread.

The outer surface and/or structure of the sheath, cup, and/or caps may be provided with decorative features.

The container is typically structured so that the cup, with the elongate items displayed therewithin, may be returned to the sheath by dropping the cup into the sheath at the top of the sheath.

DETAILED DESCRIPTION

Figure 1:
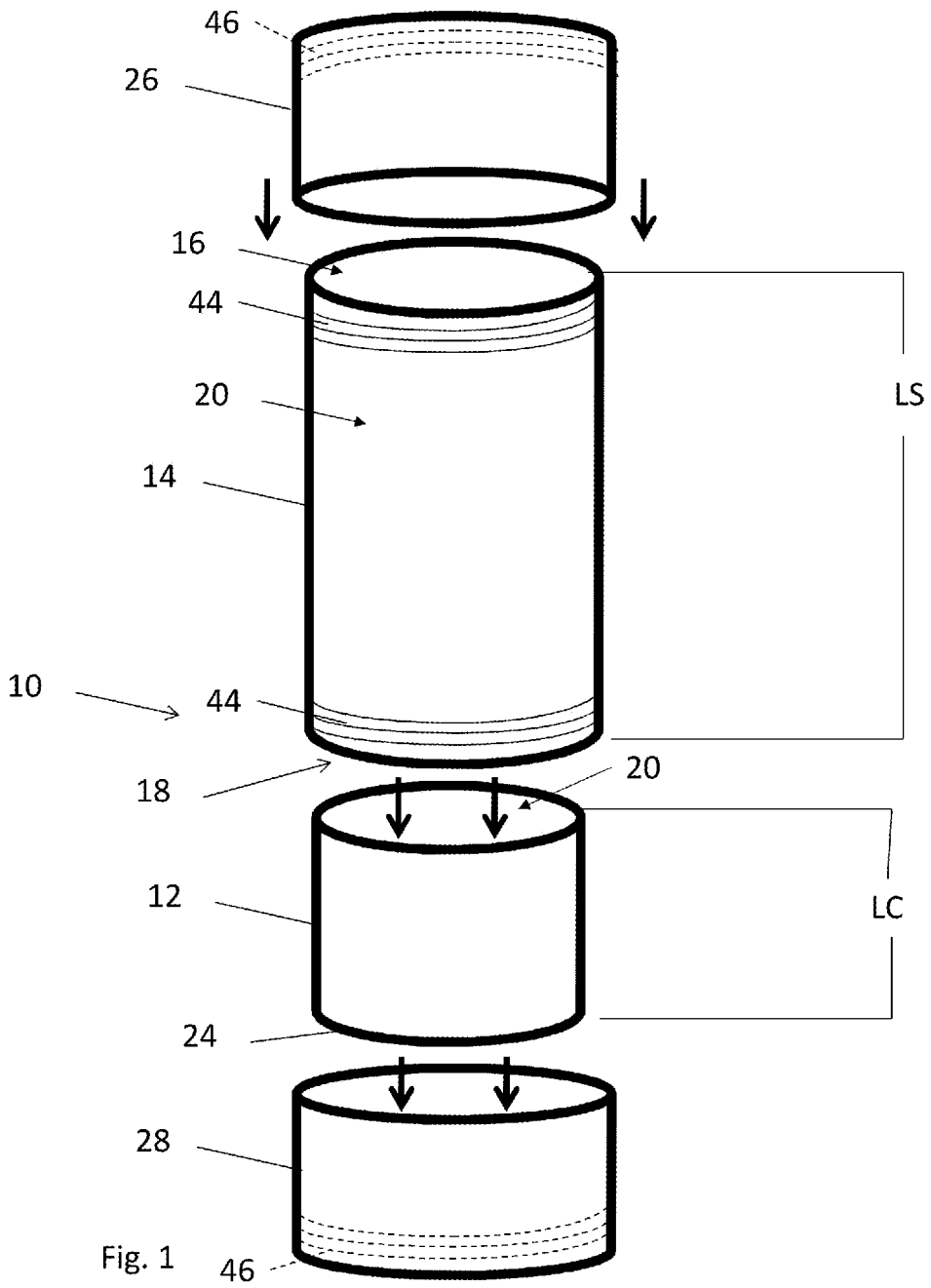
FIG. 1 is an exploded side view of the components of an embodiment of the container described herein.

As may be seen in FIGS. 1-7, an embodiment of a container 10 may carry one or more elongate items T and include a cup 12 for presenting on a flat surface S the items T for selection and use. Elongate items T may be, for example, brushes, such as makeup brushes, which define a length LT of the longest brush of those stored and displayed in cup 12.

Container 10 typically includes a sheath 14 defining a first open end 16, a second open end 18, and a channel 20 extending between ends 16 and 18. Sheath 14 defines a length LS that ordinarily is greater than the length LT of the longest elongate item T.

Cup 12 may be configured to hold elongate items T and to include an open end 22 to receive the elongate items and a base 24 opposite open end 22. Base 24 may be configured to support cup 12 on flat surface S. Cup 12 defines a length LC that typically is less than sheath length LS and less than maximum tool length LT. Preferably cup length LC is about half the max tool length LT or less than about half of LT, although other lengths may be used depending on the desired presentation of the tools, the variation of the length of the tools, and/or the cooperation of the cup with the sheath for storage and for transition to display.

Figure 2:
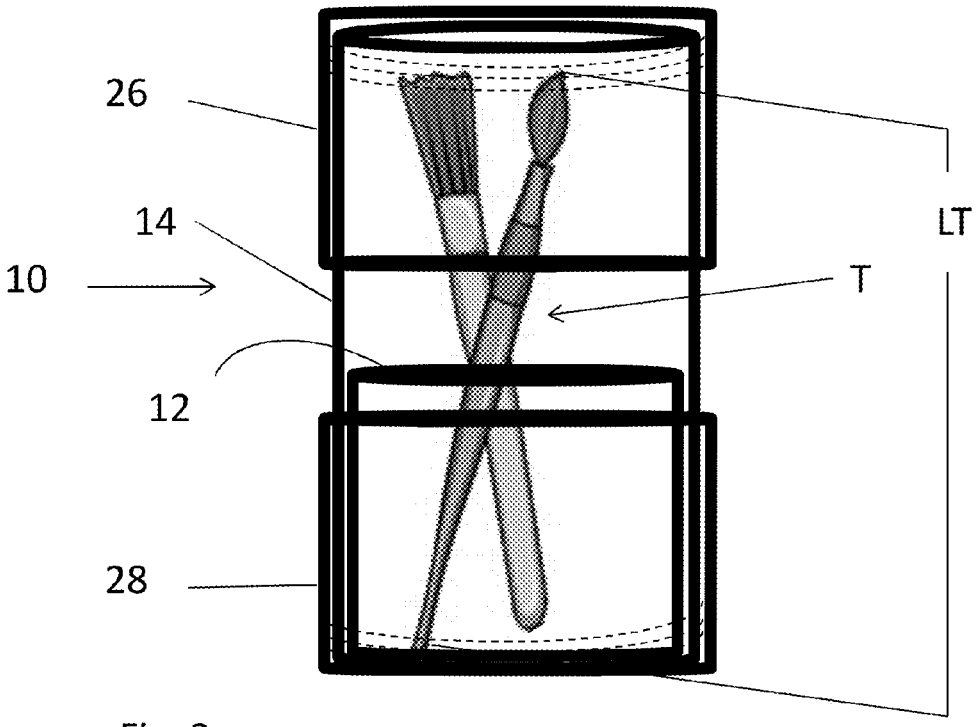
FIG. 2 is a side view of a sheath, cup, and caps in a storage configuration with brushes stored therewithin.

Cup 12 and sheath 14 may be releasably couplable to carry tools T within the cup and sheath. For example, FIG. 2 shows the cup, sheath, and tools in a carrying or storage configuration with cup 12 inside of sheath 14. Any releasable coupling mechanism between cup and sheath may be used as suited to a particular application for the container, such as a friction fit or a detent and ring structure or a screw thread. Alternatively, cup 12 may fit inside sheath 14 without any coupling mechanism.

Container 10 may include one or more caps, such as first and second end caps 26 and 28. Typically each of caps 26 and 28 defines a first open end, 30 and 32, respectively, configured to fit over one of open ends 16 and 18 of sheath 14. Caps 26, 28 may provide for maintaining the coupling of cup 12 and sheath 14 in the storage configuration. For example, one or both of caps 26, 28 may include a retaining structure releasably connecting the caps to the sheath, such as a friction fit or a detent 40 and ring 42 structure (see FIG. 7) or a screw thread 44 on the sheath and on the cap 46 (see FIGS. 1-6).

Cup 12 defines an outer diameter that preferably is smaller than an inner diameter of sheath 14 so that cup 12 fits inside channel 20 of sheath 14. Caps 26, 28 define inner diameters that are preferably greater than an outer diameter of sheath 14 so that caps 26, 28 fit over the ends of sheath 14. These dimensions may be varied to provide variations between tight and loose fittings of the cup, sheath, and caps.

Figure 4:
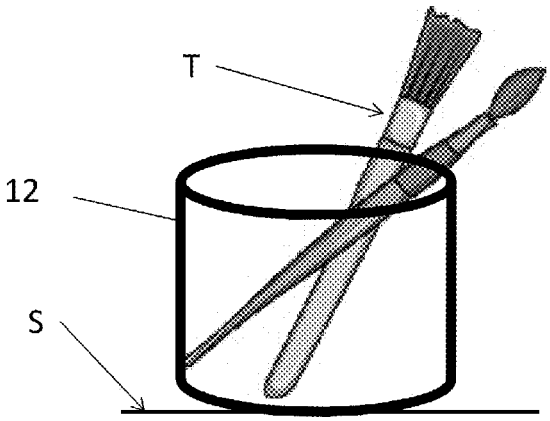
FIG. 4 is a side view of the cup in the display configuration with brushes presented in the cup for the user's selection.

As shown in FIG. 4, cup 12, with sheath 14 removed, is configured to present items T for selection and use. Sizing of an inner diameter of cup 12, as well as length LC of cup 12, relative to the size and number of tools T allows for variation on the display of tools T. Preferably cup length LS is less than, or about equal to, about half the length LT of the longest tool. Alternatively, the function of the cup in holding the brushes for use and display may be handled by one or both of the end caps, and the cup not used with the container.

Cup 12 in its transitioning from display to storage and back to display configurations may be oriented in either direction relative to sheath 14. That is, base 24 of cup 12 may be at either end 16 or 18 of sheath 14. Caps 26, 28 preferably allow the user to determine at which end of sheath 14 the base 24 of cup 12 is adjacent. For example, caps 26, 28 may be provided with a transparent or translucent panel, or mesh or other openings in one or both of their structures to allow the user to see or otherwise to determine the location of the cup and/or elongate items inside the sheath. The see-through portion on the caps or other means allows the user to determine, with the container standing up, which end holds the handle of the brushes because the cup and the brushes are visible through the caps.

It will be understood that each time the user takes the cup and brushes out of sheath 14 and then returns them to sheath 14 by the method of dropping the cup and the brushes into the top end of the sheath, the direction of the cup relative to the sheath is reversed. Thus, in FIGS. 5-7, what had been the upper cap 26 is on the bottom end of sheath 14, and, in FIG. 7, what had been the lower cap 28 is being installed on the top of sheath 14.

Figure 3:
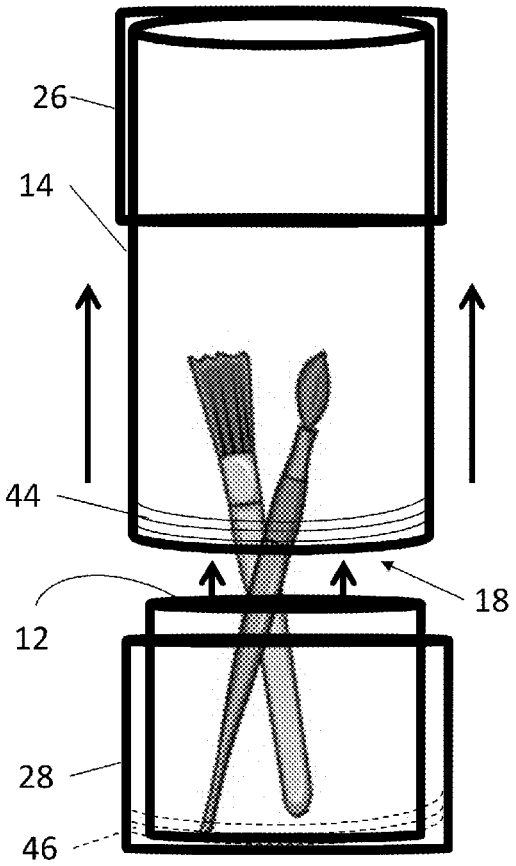
FIG. 3 is a side view of the sheath and the upper cap being removed from the cup and lower cap for access to the brushes and FIG. 3*a* is a side view of the sheath and upper cap placed on the surface alongside the cup and lower cap.
Figure 3A:
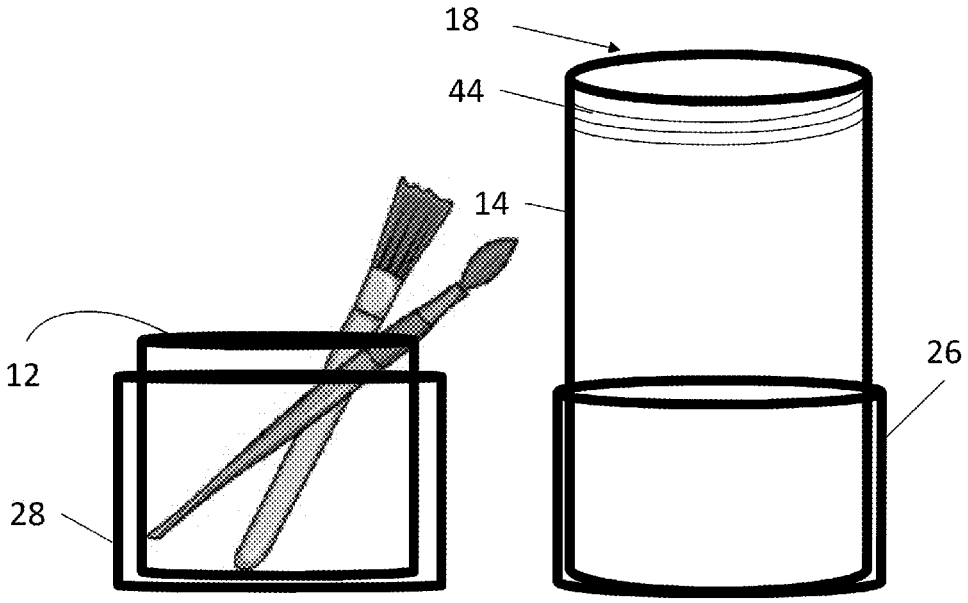

The operation and reconfiguration of the container are shown in the FIGS. 2-7. The storage configuration is best seen in FIG. 2, where tools T are in cup 12 inside sheath 14 with caps 26, 28 in place. Typically transition toward the display configuration begins with removal of sheath 14 and upper cap 26 as indicated in the arrows in FIG. 3. Also shown in FIG. 3 are arrows indicating the removal of cup 12 with tools T from lower cap 28. Cup 12 with tools T may then be placed on surface S for display and selection of the tools by the user as shown in FIG. 4 and alternatively cup 12 may remain in the lower cap for display and selection as shown in FIG. 3*a*.

It will be understood that cup 12 may alternatively remain in cap 28 (or cap 26) during display and use. Cup 12, with or without one of the caps, holds the brushes generally upright for selection and use while the cup rests on an efficiently sized footprint relative to the number of brushes being held. The cup can be placed in a small, restricted area for convenient selection and use of the brushes.

Figure 5:
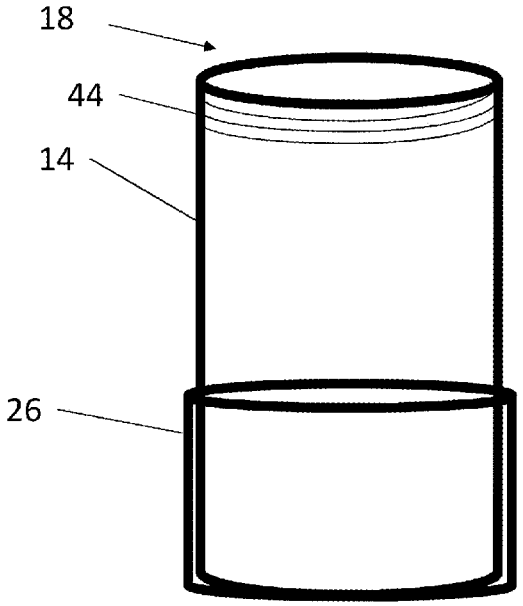
FIG. 5 is a side view of the sheath and what had been the upper cap, now on the bottom ready for reinsertion of the cup with the brushes.
Figure 6:
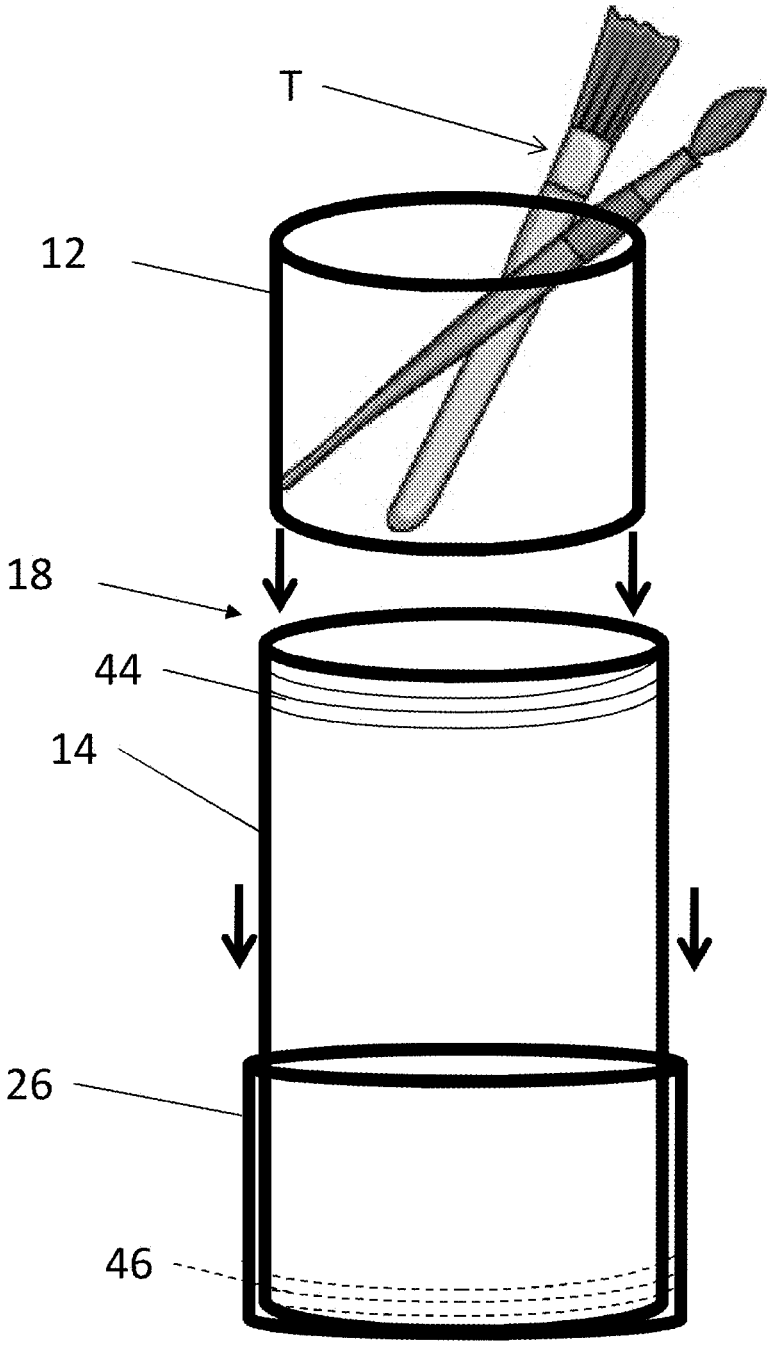
FIG. 6 is a side view of the cup and brushes being inserted into the sheath from the top, with what had been the upper cap in place on the sheath.

For transition back to the storage configuration, sheath 14, with what had been the upper cap 26 can be placed on a surface or held in the hand with the cap on the bottom, as shown in FIGS. 5 and 6. As best seen in FIG. 6, with cup 12 removed from what had been lower cap 28, cup 12 and brushes T may be reinserted into sheath 14 and cap 26. The caps 26 and 28 are typically interchangeable so the user may switch the direction for each reconfiguration. Alternatively the caps may be specialized as an upper and a lower cap and/or for other reasons maintained in that orientation through reconfigurations.

Figure 7:
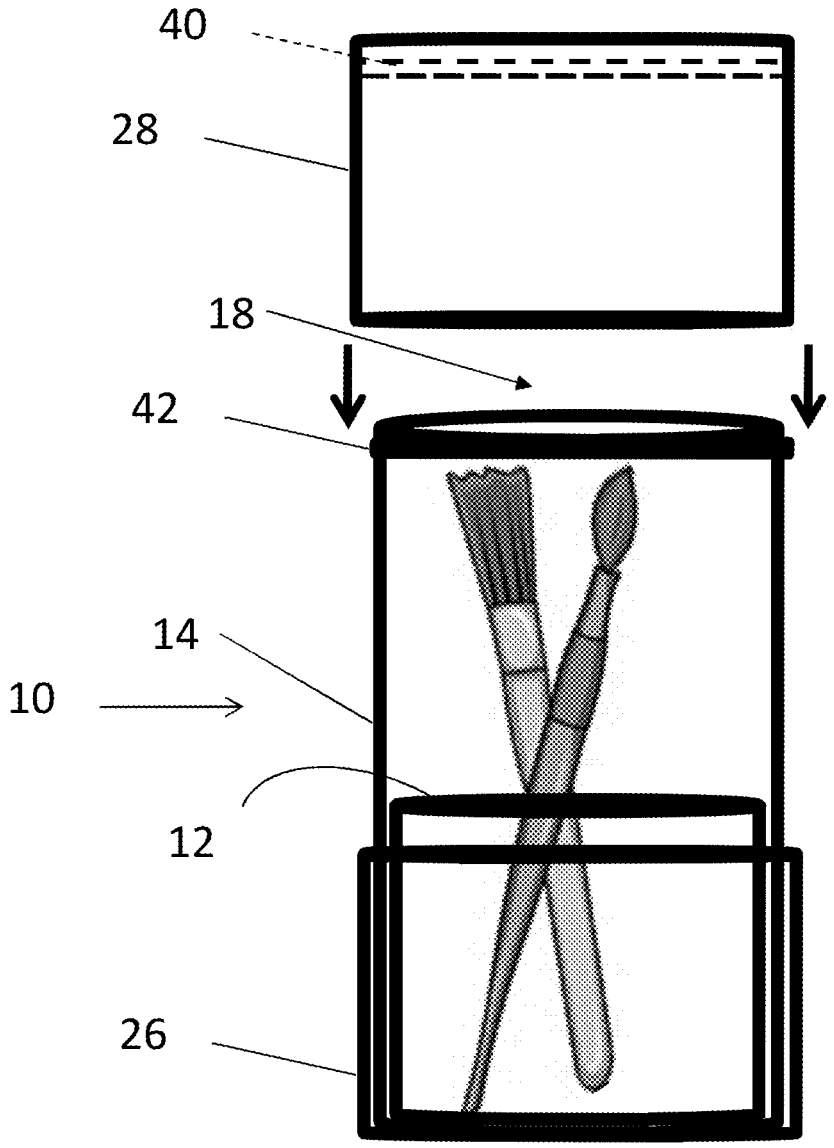
FIG. 7 is a side view of the sheath with the cup and brushes inside and what had been the upper cap on the bottom, with what had been the lower cap being reinstalled on top.

In any case, a cap is typically placed on the bottom of sheath 14 as shown in FIGS. 5 and 6. Arrows in FIG. 6 show insertion of sheath 14 into cap 26 and the insertion of cup 12 into sheath 14. It will be understood that the insertion of cup 12 with brushes T in a downward direction into sheath 14 tends to eliminate damage to the brushes, particularly to the bristles, as compared to installing a cap over the brushes. Reinstallation of cap 28 on the top of sheath 14, as shown in FIG. 7, completes transition to the storage configuration.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in any claims are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A container for carrying one or more elongate items and for presenting on a flat surface the items for selection and use, the items including a longest item defining a length, the container comprising:

a. a sheath, defining a first open end, a second open end, and a channel extending between the ends, the sheath defining a length greater than the length of the longest elongate item;

b. a cup configured to pass through the first open end, the channel, and the second open end of the sheath and to hold the elongate items, the cup including an open end to receive the elongate items and a base opposite the open end configured to support the cup on the flat surface, wherein the configurations of the cup and sheath allow the cup to be inserted in a direction relative to the sheath and allow the sheath to be removed from the cup in the same relative direction as the cup is inserted in the sheath, the cup defining a length, wherein the cup length is not greater than the length of the sheath, wherein the cup and the sheath are releasably couplable to carry the elongate items within the cup and sheath, and wherein the cup, with the sheath removed, is configured to present the items for selection and use;

c. first and second caps, each cap defining a first open end configured to fit over one of the open ends of the sheath to maintain the coupling of the cup and sheath, and each cap further defining a panel opposite the first open end of the cap.

2. The container of claim 1 wherein the cup length is less than about half the length of the longest elongate item.

3. The container of claim 1 wherein the cup fits inside the channel of the sheath.

4. The container of claim 1 wherein the sheath defines a substantially cylindrical shape and the cup defines a substantially cylindrical shape.

5. The container of claim 4 wherein the cup defines a diameter and the sheath defines a diameter, and wherein the cup diameter is less than the sheath diameter.

6. The container of claim 1 wherein the panel of each of the caps includes a see-through portion that allows a view of the cup and elongate items within the sheath.

7. The container of claim 1 wherein the caps include a retaining structure releasably connecting the caps to the sheath.

8. The container of claim 7 wherein the retaining structure is a friction fit.

9. The container of claim 8 wherein the retaining structure is a detent and ring structure.

10. The container of claim 8 wherein the retaining structure is a screw thread.

11. A method of using a container to carry and to present one or more elongate items, the method comprising:

a. providing a sheath defining a first open end, a second open end, and a channel extending between the ends;

b. providing a cup having an open end and a base opposite the open end, the cup configured to pass through the first open end, the channel, and the second open end of the sheath;

c. placing the elongate items in the cup;

d. placing the cup inside the sheath in a direction relative to the sheath with the base of the cup adjacent the first end of the sheath;

e. providing first and second caps, each cap defining a first open end, and each cap further defining a panel opposite the first open end of the cap;

f. placing the first cap over the first end of the sheath;

g. placing the second cap over the second end of the sheath;

h. removing the sheath and the second cap from the cup by lifting the sheath and second cap so that the cup passes through the first open end of the sheath in the same relative direction as the cup was placed inside the sheath;

i. placing the cup on a flat surface for selection and use of the items;

j. returning the cup to the inside of the sheath by passing the cup through the first open end of the sheath.

12. The method of claim 11 further including a step, after removing the sheath from the cup, of removing the cup from the first cap.

13. The method of claim 11 further including a step, after returning the cup to the inside of the sheath, of replacing the second cap on the sheath.

14. The method of claim 11 wherein the step of returning the cup to the inside of the sheath, includes placing the cup inside of the sheath with the base of the cup adjacent the second end of the sheath.

15. A container of tools comprising:

a. a sheath defining a first open end, a second open end, and a channel extending between the ends;

a cup placed inside the channel of the sheath, the cup configured for selective removal from the sheath through the first open end of the sheath and through the second open end of the sheath, the cup including an open end and a base opposite the open end configured to support the cup on a flat surface;

b. one or more elongate items placed within the cup;

c. first and second caps, each cap defining a first open end configured to fit over one of the open ends of the sheath to maintain the cup in the sheath, and each cap further defining a panel opposite the first open end of the cap, wherein the configurations of the cup and sheath allow the cup to be inserted in a direction relative to the sheath and allow the sheath to be removed from the cup in the same relative direction as the cup is inserted in the sheath.

16. The container of claim 15 wherein the sheath defines a substantially cylindrical shape and the cup defines a substantially cylindrical shape.

17. The container of claim 15 wherein each panel on each of the caps includes a portion that of each of the caps allows a view of the cup and elongate items within the sheath.

18. The container of claim 15 wherein the caps include a retaining structure releasably connecting the caps to the sheath.

19. The container of claim 15 wherein the panel on at least one of the caps includes a transparent portion.

20. The container of claim 15 wherein the panel on at least one of the caps includes a translucent portion.

* * * * *